United States Patent [19]

Gueneau

[11] Patent Number: 4,653,282

[45] Date of Patent: Mar. 31, 1987

[54] PROCESS AND APPARATUS FOR SUPERHEATING A REFRIGERATION FLUID

[75] Inventor: Michel Gueneau, Paris, France

[73] Assignee: Pactole S.A., Rueil Malmaison, France

[21] Appl. No.: 651,216

[22] Filed: Sep. 14, 1984

[30] Foreign Application Priority Data

Sep. 16, 1983 [FR] France ..... 83 14795

[51] Int. Cl.[4] ..... F25B 7/00

[52] U.S. Cl. ..... 62/79; 62/225; 62/503

[58] Field of Search ..... 62/225, 503, 79

[56] References Cited

U.S. PATENT DOCUMENTS

| | | | |
|---|---|---|---|
| 2,647,377 | 8/1953 | Cartter et al. | 62/225 |
| 3,420,071 | 1/1969 | Bottum | 62/503 |
| 3,421,339 | 1/1969 | Volk et al. | 62/159 |
| 3,621,673 | 11/1971 | Foust | 62/503 |
| 3,766,748 | 10/1973 | Bottum et al. | 62/243 |
| 3,803,865 | 4/1974 | Newton | 62/225 X |
| 4,217,765 | 8/1980 | Ecker | 62/503 |
| 4,236,381 | 12/1980 | Imral et al. | 62/324 R |
| 4,406,137 | 9/1983 | Demuth et al. | 62/238.6 |
| 4,510,762 | 4/1985 | Richarts | 62/238.6 X |
| 4,517,799 | 5/1985 | Hanaoka et al. | 62/238.6 X |

FOREIGN PATENT DOCUMENTS

| | | |
|---|---|---|
| 3206967 | 9/1983 | Fed. Rep. of Germany . |
| 2056646 | 3/1981 | United Kingdom . |

*Primary Examiner*—Lloyd L. King

*Attorney, Agent, or Firm*—Weiser & Stapler

[57] ABSTRACT

Process and apparatus enabling the superheating of the refrigerant fluid of a thermal engine heat pump before its introduction into the compressor. It consists of a surge tank 1 comprising an internal skirt 15 which constitutes a heat exchange surface between the refrigerant fluid and the exhaust gases of the engine. Application to heat pumps.

13 Claims, 5 Drawing Figures

PROCESS AND APPARATUS FOR SUPERHEATING A REFRIGERATION FLUID

The present invention relates to a process for superheating a gaseous refrigerant fluid before its introduction into the compressor of a thermal engine heat pump, and for simultaneously cooling and condensing the water vapor contained in the exhaust gases of said engine. It also relates to an apparatus for practicing this process.

The principle of heat pumps with thermal engines is well-known to persons skilled in the art. For example, it is described in European Patent Application No. 81/400,340— "Heating System for Residential and Industrial Use".

In conventional electric heat pumps, it is known to superheat the refrigerant fluid before its introduction into the compressor so as not to introduce liquid into the compressor. To this end, it is generally arranged so that a portion of the evaporator functions as a superheater, and to complete this superheating by using the heat energy dissipated by the electric driver motor of the compressor. In the case of immersed motor heat pumps of the type described in the above-mentioned patent application, it is not possible to complete the superheating in this manner and one is therefore compelled to cause a larger portion of the evaporator to function as superheater, which is very detrimental because the exchange surfaces of the evaporator are efficient only when the secondary fluid—that is the refrigerant fluid—is in liquid form.

On the other hand, there has also been proposed several solutions permitting the vaporizing of the liquid refrigerant portion before its introduction into the compressor, especially in the case in which the evaporator functions without superheating. This, for example, is the embodiment described in German Pat. No. 3,206,967, which contemplates controlling the supply of the evaporator by a float valve controlled as a function of the level of the refrigerant fluid measured downstream from the evaporator. Such an embodiment requires vaporization of the refrigerant fluid, which is accomplished, in the case of German Pat. No. 3,206,967, by a liquid-gas heat exchanger in which the gas is the exhaust gas of the drive engine for the compressor.

Thus, the object of the present invention is to provide a process which enables one to obtain superheating of the gaseous portion of the refrigerant fluid without reducing the efficiency of the evaporator, in the case of a heat pump whose compressor is driven by a heat engine. Further, this process makes it possible to simultaneously cool the water vapor contained in the exhaust gas of the engine and of the condensor.

A second object of the invention is an apparatus for practicing such a process, the apparatus being easily adaptable to existing installations.

The first object is achieved in that the invention involves a superheating process for a gaseous refrigerant fluid before its introduction into the compressor of a thermal engine heat pump, characterized in that there is used the residual heat energy of the exhaust gases of said thermal engine to achieve the superheating.

In accordance with this process, heat exchange takes place between the entirety of the exhaust gases and said fluid in a region located in the immediate vicinity of the compressor.

The second object is achieved in that the invention involves an apparatus comprising a heat exchanger which enables an exchange between the refrigerant fluid and the exhaust gases, and comprising an acceleration region for said gaseous refrigerant fluid.

Preferably, the exchanger is contained in a surge tank located upstream from the compressor.

In accordance with a specific embodiment of the apparatus according to the invention, the exchanger uses as the exchange surface the enclosure of said surge tank.

According to a supplemental characteristic, said enclosure is cylindrical about a vertical axis, and is closed at its two extremities.

The upper extremity is provided with an inlet tubing and with an outlet tubing. The latter comprises a lower portion which has the shape of a "U" whose first branch is open to the interior of the enclosure and is located substantially facing the inlet tubing, and whose second branch is connected to an upper vertical portion extending to the exterior of the enclosure. In accordance with the invention, this surge tank comprises an internal, cylindrical, closed skirt in its upper extremity which is located between the inlet tubing and the first extremity of the lower portion of the outlet tubing. It is further provided with an orifice for the passage of the upper portion of the outlet tubing.

Preferably, the lower extremity of the skirt is completely open and is located at a level above the extremity of the lower portion of said outlet tubing, which can include one or more lateral orifices located in the lower portion of the "U".

According to a supplemental characteristic of the invention, the cylindrical enclosure of the surge tank is surrounded by an outer cylindrical enclosure, comprising an inlet tubing for the exhaust gases and an outlet tubing.

Preferably, said outer enclosure surrounds the lower end of the surge tank.

Thus, the apparatus and the process according to the invention make it possible to carry out superheating of the gaseous portion of the refrigerant fluid, which brings about an increase in the efficiency and in the power of the heat pump extending from better use of the evaporator. Moreover, this makes possible cooling of the exhaust gases to a temperature which can read 30° or 40° C. with practically complete condensation of the water vapor, and reduction of noise.

Yet other characteristics, as well as the advantages of the invention, will appear more clearly from a reading of the following description of an embodiment provided in illustrative manner, with reference to the attached drawings in which.

Figure 1:
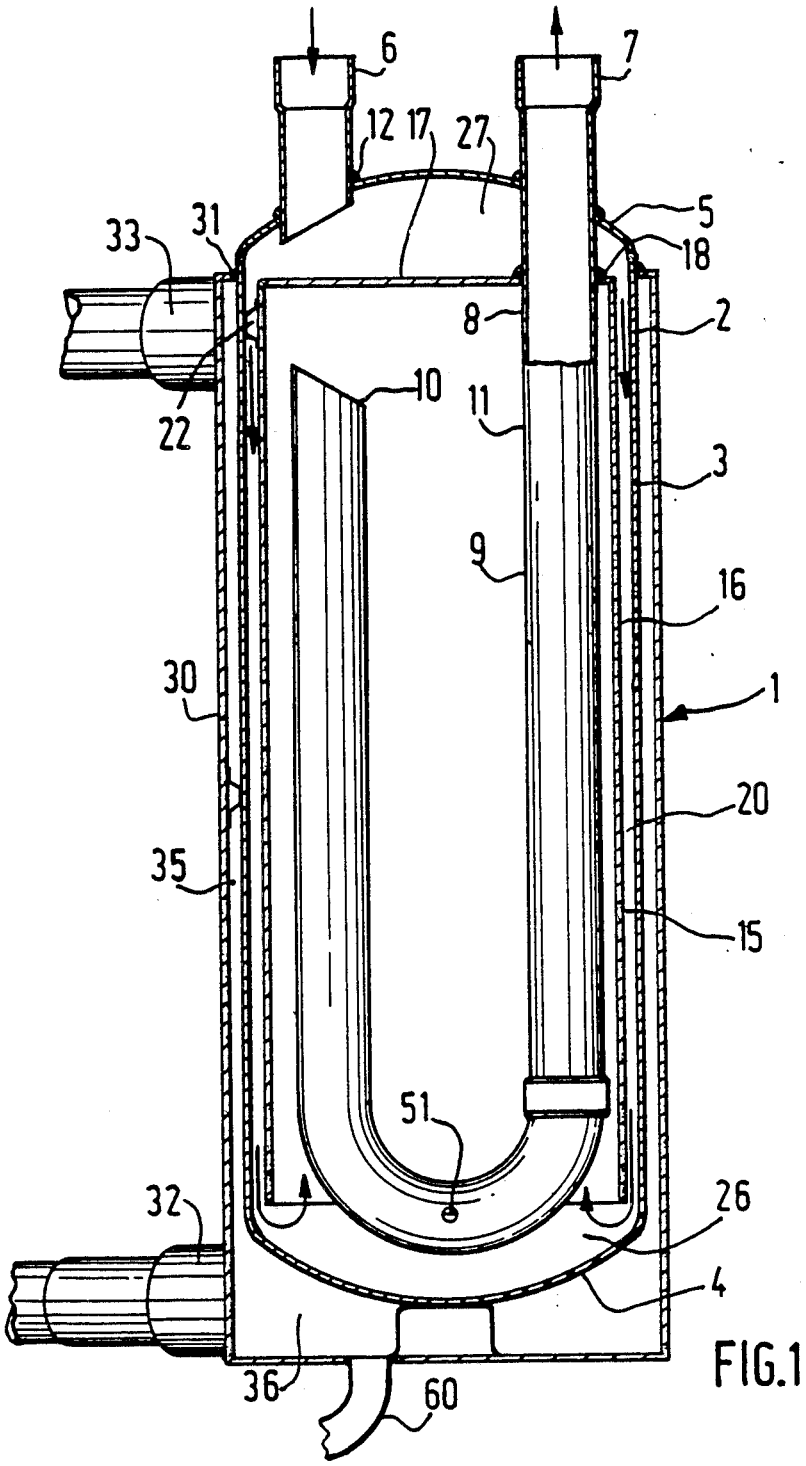
FIG. 1 is a transverse section through an apparatus according to the invention.

The surge tank 1 shown in FIG. 1 comprises a cylindrical enclosure 2 formed by a side wall 3, and a lower end 4 and an upper end 5. The two ends 4 and 5 are spherical caps. The upper end 5 is provided with an inlet tubing 6 and an outlet tubing 7. The inlet tubing 6 opens slightly along the side of the end 5 to which it is welded, at 12.

The outlet tubing 7 comprises an upper cylindrical portion 8 which opens to the outside and a lower portion 9 which has the shape of a "U". Branch 10 of the "U" is located substantially opposite the tubing 6, but opens at a significantly lower level. The end 11 is connected to the upper cylindrical portion 8.

An internal skirt 15 is positioned inside the enclosure 2. It comprises a side wall 16 and an upper wall 17 provided with an orifice 18 for the passage of the tube 8. The skirt 15 and the enclosure 2 define an annular volume 20, an upper dome 27 and a lower dome 26.

Two sets of three centering pegs 22, 23, 24 maintain constant spacing between the skirt 15 and the enclosure 2. The entire lower portion of the skirt is open. It is located at a level slightly higher than that of the lower portion of the horizontal branch of the "U".

An outside enclosure 30 surrounds the assembly. It is connected to the upper portion of the side wall 3 of the enclosure 2 by an annular crown 31. It comprises an inlet tubing 32 and an outlet tubing 33 for the exhaust gases coming from the drive motor of the compressor. The enclosure 30 and the enclosure 2 define an external annular volume 35 and a lower external dome 36. The displacement between the two enclosures is maintained by a set of centering pegs 37, 38, 39.

Figure 3:
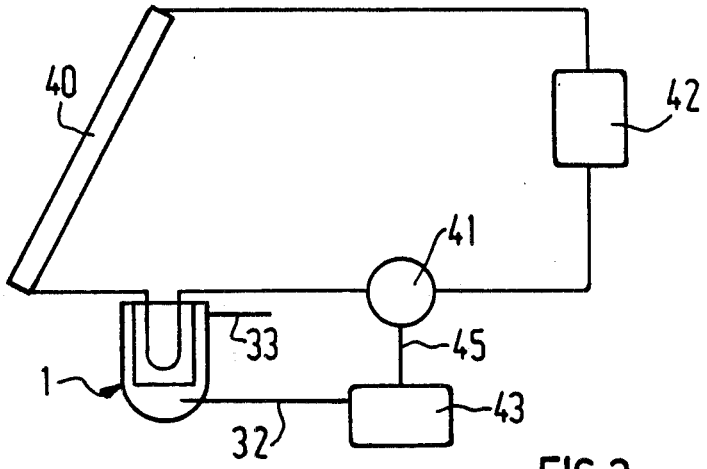
FIG. 3 is a view of an installation comprising an apparatus according to the invention.

The apparatus 1 according to the invention is made part of a heat pump, such as is schematically indicated in FIG. 3, in which there is shown the evaporator 40, the compressor 41, the condensor 42, and the expansion valve 46. The compressor 41 is rotated by the thermal engine 43, whose exhaust gases are delivered to tubing 32 by pipeline 33. The drive apparatus for the compressor is shown at 45. The expansion valve 46 is a thermostatic valve for external pressure equalization. It is controlled as a function of $\Delta T$ so as to permit superheating of the refrigerant fluid in the evaporator.

This apparatus functions as follows:

In normal operation, that is apart from transient episodes, the refrigerant gas passes, after leaving the evaporator, into the surge tank 1 where it is superheated before being introduced into the compressor 41.

With reference to FIG. 1, it is seen that the gas is introduced into the upper dome 21, then into the annular volume 20 which constitutes the exchange region with the exhaust gas introduced through tubing 32, the two gases being separated by the enclosure 2 of the surge tank, which thereby constitutes the exchange surface of the exchanger.

It is to be noted that the annular space 20 constitutes an acceleration region where the speed of the gas becomes sufficient to obtain the desired heat exchange, contrary to that which takes place within the surge tanks of the prior art which are not provided with an internal skirt. During this normal operation, the superheating of the gas makes it possible to rid it of the fine droplets of liquid which it contains.

In transient operation, it may happen that the gas introduced into the apparatus is mixed with a certain amount of liquified gas. This liquid portion is recovered in conventional manner at the bottom of the tank, where it can be evaporated by entrainment in the gaseous phase, through orifices 51.

The exhaust gases are introduced through the tubing 32 into the dome 36 and then recovered in the upper portion by the tubing 33. Tubes 33 and 32 are tangential relative to the outside enclosure.

As indicated above, the apparatus according to the invention, and particularly that shown in FIG. 1, has the advantage of cooling the exhaust gases and condensing the vapors which are present therein. To this end, the apparatus shown in FIG. 1 comprises a tubing 60 for removal of the condensates.

Figure 4:
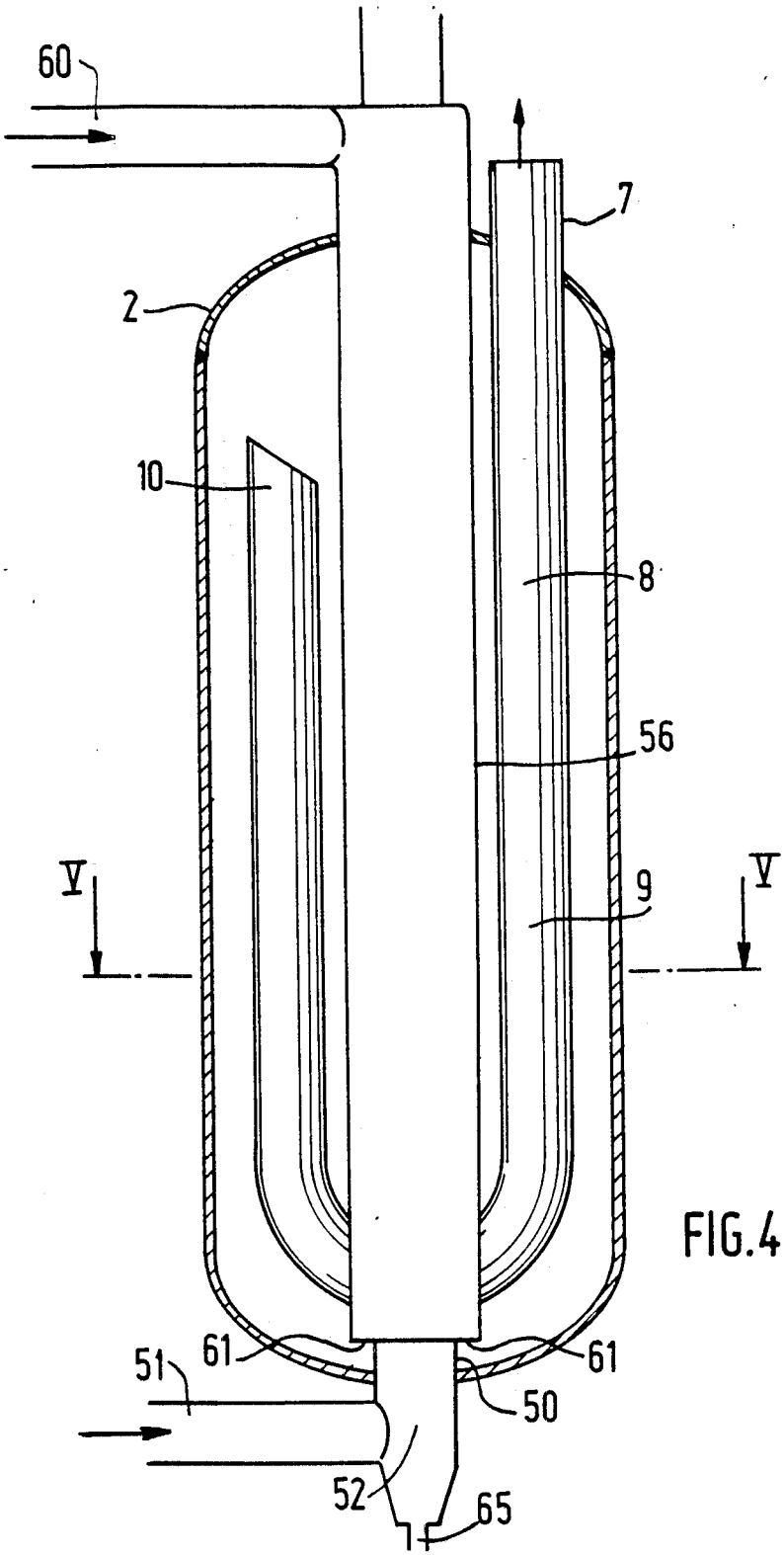
FIG. 4 is a transverse section of a second embodiment according to the invention.
Figure 5:
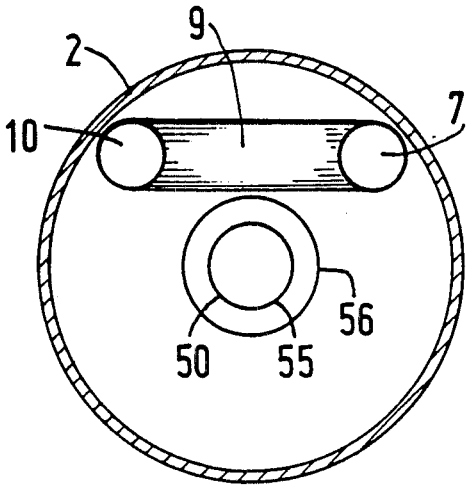
FIG. 5 is a section along line V—V of FIG. 4.

In FIGS. 4 and 5, there is shown a variant of the embodiment of the surge tank according to the invention.

It comprises, in usual manner, a cylindrical enclosure 2 and an outlet tubing 7 for the refrigerant gas comprising a first vertical branch 8, a central U-shaped portion 9 and a second vertical branch 10. A circulation tube 50 for hot gases coming from the engine traverses the cylindrical enclosure from one end to another, along its vertical axis, the inlet orifice 51 being located in the lower portion 52.

The introduction of the refrigerant gas takes place through an annular conduit 55 defined by a tube 56 which surrounds the tube 50 which circulates the hot gases. The tube 56 is provided in its upper portion with an inlet tubing 60 located outside the enclosure 2 and open at its lower end 61 at a level below the lower level of the central portion of the "U" in tubing 7.

Tube 50, for the circulation of the exhaust gases, is provided at its lower end 52 with an orifice 65 for the removal of condensates.

Figure 2:
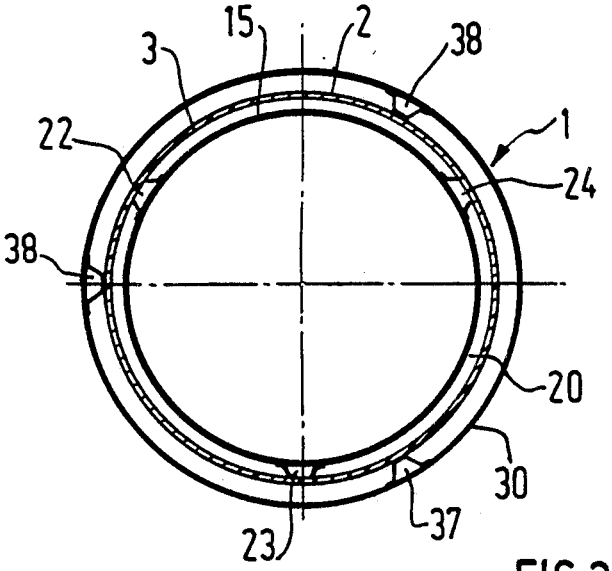
FIG. 2 is a horizontal cross-section of FIG. 1.

This apparatus functions in a manner similar to that shown in FIGS. 1 to 3. The gas-gas heat exchange wall is constituted by the wall of the tube 50 located facing the tube 56, while the annular acceleration region for the gas is defined by the hot gas circulation tube 50 and by the tube 56 for introduction of the refrigerant gas.

However, the invention is not limited to the embodiments described. To the contrary, it encompasses all its variants. In particular, with respect to the shape of the surge tank which can, for example, be a capillary system.

I claim:

1. For a heat pump having a compressor for operating upon a gaseous refrigerant fluid, a thermal engine for operating said compressor, an evaporator upstream from said compressor and a condensor downstream from said compressor, a process for superheating an evaporated gaseous refrigerant fluid having gaseous portions which contain fine liquid particles, before said gaseous refrigerant fluid is introduced into said compressor, comprising the steps of collecting exhaust gases of said thermal engine, placing said exhaust gases in heat exchange relation with said gaseous refrigerant fluid, in a heat exchanger upstream from said compressor and downstream from said evaporator, sending said evaporated gaseous refrigerant fluid from said evaporator to said heat exchanger, and applying heat energy from said exhaust gases to the gaseous refrigerant fluid containing said fine liquid particles, superheating the gaseous portions of said gaseous refrigerant fluid and removing the fine liquid particles from said gaseous refrigerant fluid before said gaseous refrigerant fluid is introduced into said compressor.

2. The process of claim 1 wherein all of the exhaust gases of said thermal engine are placed in heat exchange relation with said gaseous refrigerant fluid, in a region in the immediate vicinity of said compressor.

3. In a heat pump having a compressor for operating upon a gaseous refrigerant fluid, a thermal engine for operating said compressor, an evaporator upstream from said compressor and a condensor downstream from said compressor, an apparatus for superheating an evaporated gaseous refrigerant fluid received from said evaporator and having gaseous portions which contain fine liquid particles, before said gaseous refrigerant fluid is introduced into said compressor, comprising a heat exchanger for receiving exhaust gases from said thermal engine and for receiving the gaseous refrigerant fluid containing said fine liquid particles from said evaporator, and for causing heat exchange between said exhaust gases and said gaseous refrigerant fluid to cause superheating of the gaseous portions of said gaseous refrigerant fluid and to remove the fine liquid particles from said gaseous refrigerant fluid before said gaseous refrigerant fluid is introduced into said compressor.

4. The apparatus of claim 3 wherein said heat exchanger is associated with a surge tank located upstream from said compressor.

5. The apparatus of claim 4 wherein said heat exchanger incorporates an exchange wall comprised of the outer enclosure of said surge tank.

6. The apparatus of claim 5 wherein the outer enclosure of said surge tank is cylindrical about a vertical axis and closed at each end; wherein the upper end is provided with an inlet tubing and an outlet tubing, the outlet tubing comprising a lower portion having the shape of a "U" with a first branch which is open to the interior of said enclosure and located substantially facing the inlet tubing and with a second branch which is connected to a vertical upper portion open to the exterior of the enclosure; and wherein said enclosure surrounds an internal cylindrical skirt which is closed at its upper end such that said closed end is located between the inlet tubing and the first branch of the lower portion of the outlet tubing and is provided with an orifice for the passage of the upper portion of said outlet tubing.

7. The apparatus of claim 6 wherein the lower end of the skirt is completely open and located at a level slightly above the lower end of the lower portion of said outlet tubing.

8. The apparatus of claim 6 wherein the cylindrical enclosure of the surge tank is surrounded by a cylindrical external enclosure comprising, along lowermost portions, a tubing for the inlet of said exhaust gases and, along uppermost portions, a tubing for the exit of said gases.

9. The apparatus of claim 8 wherein the external enclosure also surrounds the lower end of the enclosure of the surge tank.

10. The apparatus of claim 8 wherein the external enclosure comprises a tubing for the removal of condensates.

11. The apparatus of claim 4 wherein the outer enclosure of said surge tank is cylindrical about a vertical axis and closed at each end; wherein the upper end is provided with an outlet tubing for the refrigerant fluid comprising a lower portion having the shape of a "U" with a first branch which is open to the inside of said enclosure and a second branch which is connected to a vertical upper portion open to the exterior of the enclosure; and comprising a first tube for the circulation of exhaust gases traversing the tank along said vertical axis and surrounded by a second tube for introducing the gaseous refrigerant fluid to the interior of the enclosure, wherein said second tube is open at its lower end and in communication with an inlet tubing located outside of said tank.

12. The apparatus of claim 11 wherein the tube for introducing the gaseous refrigerant fluid is open at its lower end at a level slightly below the lower end of the lower portion of said outlet tubing.

13. The apparatus of claim 11 wherein the tube for the circulation of exhaust gases comprises an orifice for the removal of condensates.

* * * * *